US005390866A

United States Patent [19]

Kochnev et al.

[11] Patent Number: 5,390,866

[45] Date of Patent: Feb. 21, 1995

[54] MILL DRUM

[75] Inventors: Vladimir G. Kochnev; Sergey A. Simankin, both of Spt. Petersburg, Russian Federation

[73] Assignee: Prima Industria Holdings (Proprietary) Ltd., Benoni, South Africa; a part interest

[21] Appl. No.: 123,734

[22] Filed: Sep. 20, 1993

[30] Foreign Application Priority Data

Sep. 22, 1992 [ZA] South Africa ..... 92/7229

[51] Int. Cl.[6] ..... B02C 17/22

[52] U.S. Cl. ..... 241/181; 241/183; 241/299

[58] Field of Search ..... 241/181, 182, 183, 299, 241/300

[56] References Cited

U.S. PATENT DOCUMENTS

| | | | |
|---|---|---|---|
| 221,548 | 11/1879 | Golding | 241/183 X |
| 864,357 | 8/1907 | Brown | 241/183 |
| 1,118,474 | 11/1914 | Collins | 241/183 X |
| 2,193,956 | 3/1940 | Abrams | 241/183 |
| 2,566,103 | 11/1947 | Weston . | |
| 2,731,210 | 1/1956 | Henricot | 241/183 |
| 2,801,804 | 8/1957 | Frankert . | |
| 3,125,302 | 3/1964 | Henricot | 241/183 |
| 3,804,346 | 4/1974 | Norman . | |
| 4,243,182 | 1/1981 | Dugger, Jr. . | |
| 4,329,767 | 5/1982 | Niitti . | |
| 4,394,982 | 7/1983 | Wilson . | |
| 4,406,417 | 9/1983 | Jardine et al. . | |
| 4,736,894 | 4/1988 | Ferrada et al. . | |
| 4,848,681 | 7/1989 | Eriksson et al. . | |

FOREIGN PATENT DOCUMENTS

| | | | |
|---|---|---|---|
| 143232 | 9/1951 | Australia | 241/183 |
| 171082 | 4/1952 | Germany | 241/183 |
| 68/3413 | 5/1968 | South Africa . | |
| 68/5452 | 8/1968 | South Africa . | |
| 68/7726 | 9/1968 | South Africa . | |
| 69/7114 | 9/1969 | South Africa . | |
| 72/4183 | 6/1972 | South Africa . | |
| 73/5120 | 7/1973 | South Africa . | |
| 73/7416 | 9/1973 | South Africa . | |
| 73/8271 | 10/1973 | South Africa . | |
| 75-3484 | 5/1975 | South Africa . | |
| 76/1214 | 3/1976 | South Africa . | |
| 77/0651 | 1/1977 | South Africa . | |
| 78/3574 | 6/1978 | South Africa . | |
| 7801 | 3/1911 | United Kingdom | 241/183 |

OTHER PUBLICATIONS

312133, May 1943, Alien Property Custodian.

*Primary Examiner*—Timothy V. Eley
*Attorney, Agent, or Firm*—William Squire

[57] ABSTRACT

According to the invention there is provided a mill drum comprising a hollow drum structure in use mounted to rotate about a substantially horizontal axis extending longitudinally through the bore of the drum structure. The drum structure including lifter means mounted thereto to extend into the bore of the drum structure. The lifter means in use when the drum structure rotates and material to be ground has been introduced into the drum structure, selectively catch and scoop up larger parts or fragments of the mill contents from the bottom of the drum structure while allowing smaller particles to remain at the said bottom. The lifter members thereafter drop the scooped up parts or fragments at or towards the upper end of the rotating drum structure causing the parts or fragments to fall onto the rest of the contents at the bottom of the drum structure and thus causing a milling action.

24 Claims, 2 Drawing Sheets

MILL DRUM

INTRODUCTION AND BACKGROUND

THIS invention relates to mills, and more particularly it relates to mills for milling ore or the like.

A common type of mill used in the mining industry for milling ore includes a drum structure mounted to rotate about a horizontal axis extending longitudinally through the bore of the drum structure. The drum structure usually includes an inlet end through which ore is fed into the structure, and an outlet end through which the milled ore is discharged. The outlet end often includes a screen which only allows ore fragments smaller than a predetermined size to be discharged from the drum structure. Because of the high abrasion forces present in the drum structure, the bore thereof is usually lined with an interchangeable liner. The liner prevents the drum mantle itself from becoming worn out as a result of the abrasion forces and when the lining is worn out it can be replaced by a new lining.

Most mills also include lifter bars mounted on the liner to extend into the drum structure. The lifter bars comprise elongate bars extending along the length of the bore of the drum structure as solid walls spaced apart from and substantially parallel to each other. Each elongate bar usually comprises interchangeable sections located next to each other along the length of the drum, each section being separately replaceable as it becomes worn out.

In use the drum structure of the mill is rotated, causing the lifter bars to catch and scoop up the mill contents in the bottom of the structure. The scooped up contents slide from the lifter bars when approaching the top of the mill and fall onto the contents still located in the bottom of the drum structure thereby crushing and milling the ore.

In the case of a pure autogenous mill the mill contents comprise only ore. In the case of a semi-autogenous mill the mill contents comprise ore and grinding media such as steel balls or the like. The grinding media enhances the milling action when, during rotation of the drum it is scooped up and dropped onto the ore in the bottom of the drum.

A disadvantage of the type of mill described above is that the lifter bars indiscriminately scoop up all sizes of ore fragments. Not only are the large ore fragments, which are more effective in the milling process scooped up and dropped onto the rest of the ore, but so are the small ore fragments which are less effective in the milling process. Energy is therefore wasted to some extent by scooping up and hoisting the small ore fragments. Another and closely related disadvantage is that the small ore fragments usually migrate through the larger ore fragments to the bottom of the drum structure and thus tend to fill up the lifter bars with the result that less of the larger ore fragments [and other grinding media in the case of a semi-autogenous mill] are scooped up by the lifter bars.

OBJECT OF THE INVENTION

It is accordingly an object of the present invention to overcome or at least reduce the above disadvantage.

SUMMARY OF THE INVENTION

According to the present invention a mill drum comprises a hollow drum structure in use mounted to rotate about a substantially horizontal axis extending longitudinally through the bore of the drum structure; and lifter means mounted in the drum structure, to extend into the bore of the drum structure, which lifter means in use when the drum structure rotates and material to be ground has been introduced into the drum structure, selectively catch and scoop up larger parts or fragments of the mill contents from the bottom of the drum structure while allowing smaller particles to remain at the said bottom and thereafter dropping the scooped up parts or fragments at or towards the upper end of the rotating drum structure causing the parts or fragments to fall onto the rest of the contents at the bottom of the drum structure and thus causing a milling action.

The drum structure may be cylindrically shaped with a substantially circular cross-sectional configuration. The drum structure may include separate inlet and outlet apertures located in the opposing ends of the structure. The outlet aperture may be provided with a classification mechanism such as a screen for only allowing particles smaller than a predetermined size to pass through the outlet aperture.

The drum structure may also include an interchangeable liner for lining the bore thereof. In use the liner may be exchanged when worn out. Preferably the liner comprises a number of liner sections individually securable to the bore of the drum structure allowing the liner sections to be replaced individually when worn out.

The lifter means may comprise a number of lifter members mounted to the mantle of the drum structure to extend substantially radially inwardly into the drum structure, the lifter members being spaced apart from each other along the length of the bore of the drum structure in use to catch between them larger parts or fragments of the mill contents and allowing the smaller particles to pass between them. The lifter members may comprise elongate members extending longitudinally in a radial direction into the drum structure. Each elongate member may comprise a circular or, alternatively an angular cross-sectional configuration.

The lifter members may be of different lengths and spaced apart from each other at various distances thereby to catch between them parts or fragments of different sizes.

Preferably the lifter members are arranged in spaced apart rows, each row extending along the length of the bore of the drum structure. The lifter members may be arranged in one or more first rows comprising relatively long lifter members which are spaced relatively far apart from each other along the length of the bore in use to catch only larger parts or fragments between them while allowing the smaller parts or fragments to pass through; and one or more second rows comprising relatively short lifter members which are spaced relatively near to each other along the length of the bore to catch only smaller parts or fragments between them while allowing the larger parts or fragments to roll over them. The drum structure may include one or more additional rows wherein the lifter members are of lengths intermediate to the lengths of those of the first and second rows and spaced apart from each other at a distance intermediate the distances between the lifter members of the first and second rows thus in use to catch parts or fragments of a size intermediate to those being caught by the first and second rows.

It will be appreciated that the lengths of the different lifter members and their distances from each other will depend on the effect required from the members. Preferably, the lengths of the lifter members extending above the surface of the liner are approximately half of the diameter of the parts or fragments they are intended to catch. Preferably the distances between adjacent lifter members along the length of the bore of the drum structure are not more than 90% of the diameter of the parts or fragments they are intended to catch between them.

The lifter members are preferably secured to the liner. In one embodiment the lifter members may form an integral part of the liner and in an alternative embodiment the lifter members may be removably securable to the liner.

The mill drum may also include a number of nodules on the liner located between the lifter members. The height of the nodules and the distances between them are preferably 2 to 3 times larger than the maximum size of the required milled product. The nodules preferably form an integral part of the liner.

In use the material milled to the required size migrate through the gaps between the nodules thereby to remain at the bottom half of the drum structure. Thus energy will not be wasted to hoist these small parts or fragments and to drop them onto the rest of the contents. Furthermore by remaining in the bottom half of the drum structure these parts or fragments remain in the most favourable position from where they may be discharged from the mill drum since in most mills the discharge apertures are located in line with the bottom half of the mill drum.

The invention also relates to a mill which includes a mill drum described hereinabove. The mill may comprise an autogenous or semi-autogenous mill.

According to a further aspect of the invention there is provided liners for lining a mill drum which liners are characterised therein that they include one or more nodules and/or lifter members as described hereinabove.

Without thereby limiting the scope of the invention and by means of example only one embodiment of the invention will now be described with reference to the accompanying drawings wherein:

DESCRIPTION OF THE DIAGRAMS

In the accompanying drawings the same reference numerals are used to denote corresponding parts.

DESCRIPTION OF PREFERRED EMBODIMENT OF THE INVENTION

Figure 1:
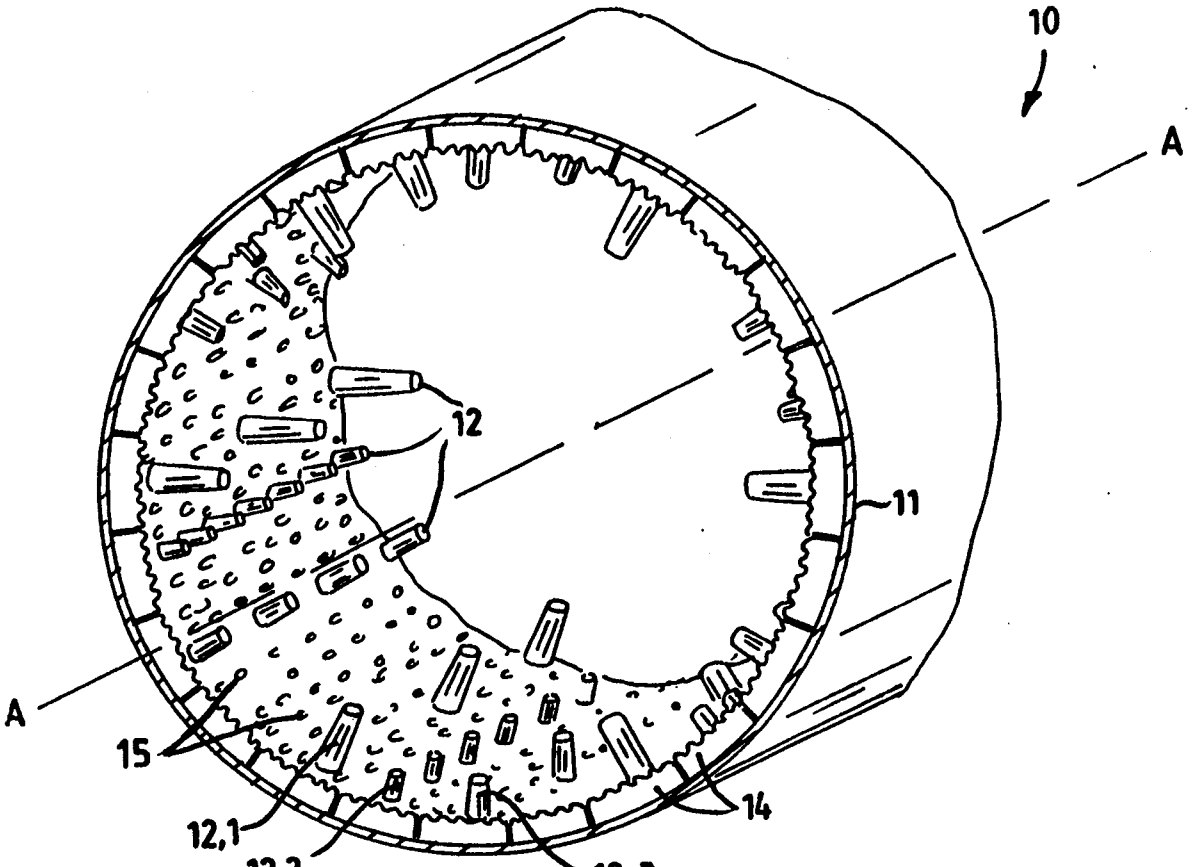
FIG. 1 is a perspective view of part of a mill drum according to the invention.
Figure 2:
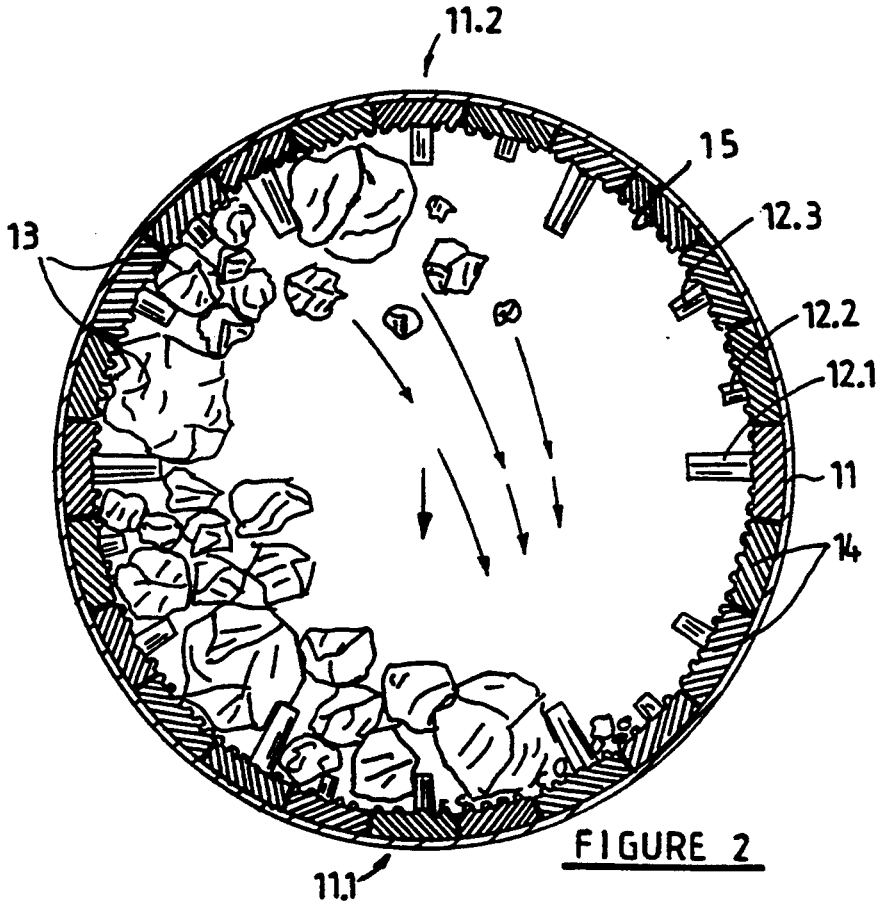
FIG. 2 is a sectioned side view of the mill drum of FIG. 1 when used for autogenous milling.
Figure 3:
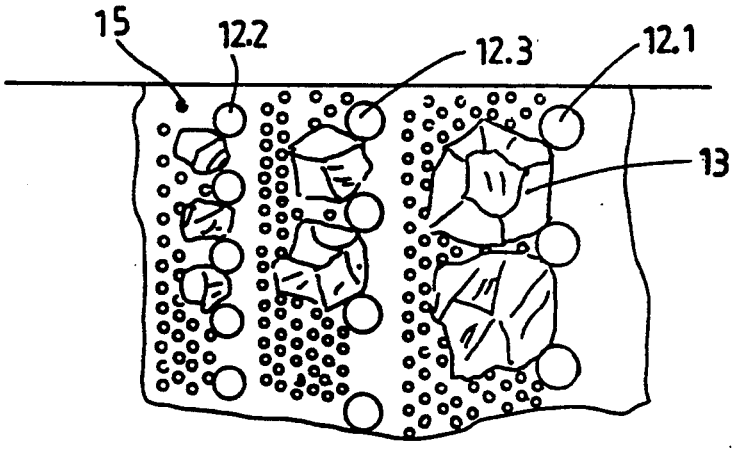
FIG. 3 is a plan view of part of the bore of the mill drum of FIG. 1 when used for autogenous milling.

Referring now to the drawings a mill drum 10 comprises a hollow drum structure 11 in use mounted to rotate about a substantially horizontal axis A—A extending longitudinally through the bore of the drum structure 11. The mill drum 10 further includes lifter means in the form of lifter members 12 mounted to the mantle of the drum structure 11 to extend into the bore thereof.

In use when the drum structure 11 is rotated and material to be ground has been introduced into the drum structure 11 the lifter members 12 scoop up larger fragments of the mill contents such as ore 13 to be milled from the bottom 11.1 of the drum structure 11 while allowing smaller fragments to remain at the said bottom 11.1. The scooped up fragments are dropped at or towards the upper end 11.2 of the rotating drum structure 11 causing the fragments to fall onto the rest of the ore at the bottom 11.1 and thus causing a milling action.

The drum structure 11 is cylindrically shaped with a circular cross-sectional configuration. The drum structure includes separate inlet and outlet apertures [not shown] in the opposing ends of the structure 11. The outlet aperture is provided with a screen [not shown] for in use only allowing fragments smaller than a predetermined size to pass through the outlet aperture. The outlet aperture and screen are usually located in line with the bottom 11.1 of the drum structure 11.

The drum structure 11 also includes a liner 14 for lining the bore of the drum structure 11. The liner 14 comprises a number of liner sections individually secured to the bore of the drum structure, allowing them to be replaced individually when worn out.

The lifter members 12 are mounted to the bore of the drum structure 11 via the liner 14 and extend radially inwardly into the drum structure 11. The lifter members 12 are of different lengths and are spaced apart from each other. The lifter members 12 comprise elongate rods of a circular cross-sectional configuration.

The lifter members of different heights are arranged in separate rows. In this embodiment there are three different types of rows namely 12.1, 12.2 and 12.3. The first row 12.1 comprises long lifter members which are spaced relatively far apart from each other along the length of the bore in use to catch larger fragments between them while allowing smaller fragments to pass through. The second row 12.2 comprises relatively short lifter members which are nearer to each other to catch smaller fragments which are still larger than the required mill size while allowing the larger fragments to roll over them. The third type of row 12.3 comprises lifter members of a length intermediate that of the lifter members of the first and second rows. The distances between these lifter members are also intermediate the distances between the lifter members of the first and second rows. The lifter members 12 in the third type of row 12.3 thus in use catches between them fragments of a size intermediate to those being caught by the first and second rows.

The lengths of the different lifter members 12 and the distances between them longitudinally along the length of the bore depend on the initial sizes of the fragments to be milled. The length of the lifter members 12 are approximately half of the diameter of the fragments they are intended to catch between them. The distances between the lifter members in a row are approximately 90% of the diameter of the fragments they are intended to catch between them.

The lifter members are cast as an integral part of the liner 14.

The mill drum also includes a number of nodules 15 on the liner, the nodules being located between the lifter members 12. The height of the nodules and the distances between them are preferably 2 to 3 times larger than the maximum size of the fragments milled to the required size. The nodules 15 form an integral part of the liner.

In use the fragments milled to the required size are able to migrate through the gaps between the nodules 15 thereby to remain at the bottom half 11.1 of the drum structure 11. In this way energy is not wasted to hoist these small fragments and to drop them onto the rest of the particles which process would not have contributed much to the milling action. Furthermore by remaining at the bottom half of the drum structure the fragments remain in the most favourable position to be discharged from the drum structure 11.

In use ore fragments or the like are fed into the mill drum 10. As the drum rotates the lifter members 12 in the rows 12.1 catch between them only the larger fragments while allowing smaller fragments to pass through. Smaller fragments which are still larger than the required mill size are caught between the lifter members 12 of the rows 12.2 and 12.3. Last mentioned rows in use also allow larger fragments to roll over them. The lifter members 12 hoist the larger fragments as the drum structure 11 rotates and drop the fragments at or near the top 11.2 of the mill to cause the milling action. The small fragments milled to size remain at the bottom half of the mill drum 10 and are discharged through the outlet aperture.

It will be appreciated that many variations in detail are possible without thereby departing from the scope and spirit of the invention. One such variation is, for example, to use the mill drum 10 for semi-autogenous milling in which case grinding media such as steel balls or the like are also introduced into the mill drum 10. The grinding media and ore fragments are in use, on rotation of the drum caught by the rows 12.1, 12.2 and 12.3 and hoisted to be dropped from at or near the top 11.2 of the drum structure 11 thus causing it to fall on the remaining ore at the bottom of the mill thereby milling it.

We claim:

1. A mill drum for milling fragments comprising:

a hollow bore drum structure mounted to rotate about a substantially horizontal axis extending longitudinally through the bore, said structure having a surface defining the bore, said bore having a bottom region and an upper region, said fragments being received in the bottom region; and a plurality of lifter members mounted to the drum structure and extending into the bore, said lifter members being dimensioned and spaced to selectively catch and scoop up first fragments of a first dimension and second fragments of a second dimension smaller than the first dimension from the bottom region when the drum structure rotates such that fragments smaller than the first and second fragments remain in the bottom region, the scooped up fragments at the upper region falling onto the fragments in said bottom region causing a milling action, said lifter members being arranged in at least one first row and at least one second row spaced from each other, each row extending along the longitudinal length of the bore, the at least one first row comprising lifter members of a first length projecting into the bore and having a first spacing from each other, the first length and first spacing for catching only the first fragments allowing smaller fragments to pass therethrough, the at least one second row comprising lifter members having a second length shorter than the members of the first row projecting into the bore and having a second spacing from each other, the second length and second spacing for catching only the second fragments and for allowing smaller fragments to pass therethrough while allowing fragments larger than the second fragments to roll thereover.

2. The mill drum of claim 1 wherein the structure is cylindrically shaped with a substantially circular cross section in a direction transverse the bore axis.

3. The mill drum of claim 1 wherein the drum structure includes an interchangeable liner for lining the bore.

4. The mill drum of claim 3 wherein the liner comprises a plurality of separate sections each individually releasably secured to the drum structure in the bore thereof.

5. The mill drum of claim 3 including a liner secured to the drum structure in the bore wherein the lifter members are secured to the liner.

6. The mill drum of claim 5 wherein the lifter members and the liner are one piece.

7. The mill drum of claim 5 wherein the lifter members are removably secured to the liner.

8. The mill drum of claim 5 wherein the mill drum includes a plurality of nodules on the liner between the lifter members.

9. The mill drum of claim 8 wherein the drum produces generally spherical milled fragments of a maximum third dimension, the height of the nodules from the bottom surface and the distances between the nodules are two to three times larger than the third dimension of the milled fragments.

10. The mill drum of claim 8 wherein the nodules and the liner are one piece.

11. The mill drum of claim 1 wherein the lifter members extend substantially radially inwardly into the bore of the drum structure.

12. The mill drum of claim 11 wherein the lifter members comprise elongate members having a longitudinal dimension and extend longitudinally in a radial direction into the drum structure bore.

13. The mill drum of claim 12 wherein each elongate member has a circular cross section transverse the longitudinal dimension.

14. The mill drum of claim 1 wherein the drum structure includes at least one additional row of lifter members wherein the additional row of lifter members are of lengths intermediate to the lengths of those of the at least first and at least second rows and spaced apart from each other a distance intermediate the distances between the lifter members of the first and second rows to catch fragments of a size intermediate to those being caught by the first and second rows.

15. The mill drum of claim 1 wherein the first and second fragments have first and second respective dimensions which are generally diametrical, the lengths of the lifter members extending into the bore a distance of approximately one half of the diameter of the corresponding first and second fragments.

16. The mill drum of claim 1 wherein the distances between next adjacent lifter members of the first and second rows along the length of the drum structure bore are not more than 90% of the first and second dimensions of the corresponding fragments.

17. The mill drum of claim 1 wherein the second spacing between adjacent lifter members of the at least second row is shorter than the first spacing between adjacent lifter members of the at least first row.

18. A liner construction for lining a drum structure of a mill drum, said structure having a bore extending axially along a length of the drum, the liner construction comprising:

a liner dimensioned to line the drum structure bore; and a plurality of lifter members on the liner extending inwardly of the bore, the lifter members being arranged in at least one first row and at least one second row spaced from each other and extending along the length of the bore, said at least one row comprising first lifter members of a first length spaced apart a first distance from each other along the length of the bore for catching therebetween fragments of a first dimension while allowing smaller fragments of a second dimension to pass therethrough, said at least one second row comprising second lifter members of a second length shorter than the first length spaced apart a second distance shorter than the first distance along the length of the bore to catch the fragments of said second dimension therebetween while permitting fragments larger than the second dimension to roll thereover.

19. The liner of claim 18 including a plurality of nodules thereon between the lifter members.

20. A mill drum for milling fragmented material inserted into the drum into smaller relatively fine fragments, the fragmented material comprising first fragments of at least a first dimension and second fragments of at most a second dimension smaller than the first dimension, the fine fragments being smaller than the second dimension, the drum comprising:

a mill drum structure having a bore defined by an inner cylindrical surface for rotation about an axis defined by the bore, the bore for receiving therein at least the first fragments in a first lower region, the axis being horizontal with respect to the direction of the force of gravity;

first projection means projecting into the bore from the surface, said first means being dimensioned and positioned for selectively catching only the first fragments in said first lower region as the member rotates about the axis to rotate and lift the selectively caught first fragments so that the first fragments fall in response to the force of gravity during the rotation to reduce the magnitude of the first dimension of the first fragments; and second projection means projecting into the bore from the surface, said second means for selectively catching only the second fragments in said first lower region as the member rotates about the axis to rotate and lift the selectively caught second fragments so that the second fragments fall in response to the force of gravity during rotation to reduce the magnitude of the second dimension whereby only the first and second fragments are lifted during said rotation.

21. The mill drum of claim 20 wherein the first means project from the surface into the bore a first distance proportional to the first dimension and the second means project from the surface into the bore a second distance proportional to the second dimension wherein the first and second distances are about the same relative proportion with respect to their corresponding dimensions.

22. The mill drum of claim 21 wherein the first and second distances are each about 50% of the respective first and second dimensions.

23. The mill drum of claim 21 wherein the first and second fragments each have a mass center spaced from a fragment surface thereof next adjacent to said inner cylindrical bottom surface defining a corresponding mass center distance, the first distance being no smaller than the mass center distance of the first fragments and the second distance being no smaller than the mass center distance of the second fragments.

24. The mill drum of claim 20 wherein the first and second projection means each include a plurality of respective corresponding spaced first and second projections, the spacing of the first projections from one another being greater than the spacing of the second projections from one another, the respective spacings being smaller than the respective first and second dimensions of the corresponding first and second fragments.

* * * * *